United States Patent [19]

Cobaugh et al.

[11] 4,012,107

[45] Mar. 15, 1977

[54] FEMALE TERMINALS

[75] Inventors: Robert Franklin Cobaugh, Elizabethtown; Norwood Claude Graeff, Harrisburg, both of Pa.

[73] Assignee: AMP Incorporated, Harrisburg, Pa.

[22] Filed: Dec. 17, 1975

[21] Appl. No.: 641,399

[52] U.S. Cl. ..... 339/258 P

[51] Int. Cl.[2] ..... H01R 13/12

[58] Field of Search ..... 339/17, 258, 275, 276 A

[56] References Cited

UNITED STATES PATENTS

| | | | |
|---|---|---|---|
| 3,156,517 | 11/1964 | Maximoff et al. | 339/275 B |
| 3,718,895 | 2/1973 | Reynolds et al. | 339/275 B |
| 3,796,988 | 3/1974 | Palombella | 339/258 R |
| 3,862,792 | 1/1975 | Jayne | 339/258 R |

*Primary Examiner*—Joseph H. McGlynn
*Attorney, Agent, or Firm*—AMP Incorporated

[57] ABSTRACT

A female contact particularly useful as a low profile contact inserted in a printed circuit board and comprising a tubular portion with a flared open end for receiving a male pin. A pair of opposing contact fingers extend from the flared open end and are folded back upon themselves to extend downwardly into the interior of the tubular portion. Near the open end of the tubular portion the two opposing fingers are initially close to, and substantially parallel to, the walls of the tubular portion. As they extend further into the tubular portion, the curved fingers extend away from the walls of the tubular portion and towards each other, with their concave surfaces facing each other. As a terminal post is initially inserted between the fingers the fingers are deflected apart and outwardly towards the walls of the tubular portion so that a point on said fingers will be forced against the wall of the tubular portion. Such points of contact between the spring fingers and the wall will move continuously down said wall and away from the open end thereof as the post is further inserted, thereby in effect causing the spring fingers to be cantilever beams which grown increasingly shorter as the post is inserted further thereinbetween.

11 Claims, 10 Drawing Figures

FEMALE TERMINALS

BACKGROUND OF THE INVENTION

This invention relates generally to female terminals and more particularly to a low profile contact having a female receptacle which is insertable through a hole in a printed circuit board and which is constructed to receive male terminals having size and entrance angles of wide tolerances without appreciably altering the mechanical and electrical characteristics between the female receptacle and the inserted male terminal.

A particular type contact used extensively today, particularly with substrates such as printed circuit boards comprises at one end a female receptacle which fits securely within an aperture in a printed circuit board, and at the other end comprises a post or other type terminal which extends through the printed circuit board and forms a terminal for connection to additional conductors. Such additional conductors can be connected to the extended-through portion by wire wrap, solder or any other suitable method for securing a wire to such extended-portion. Components having male type terminals can then be mounted on the circuit board by inserting the male terminals into the female receptacles secured in the board.

In applications where space is limited, such as hand calculators, it is advantageous that the female portion of a contact have a low profile with respect to the surface of the printed circuit board, i.e., the receiving opening of said female portion should be close to the surface of the circuit board. Consequently, components mounted in such low profile contacts will also be positioned quite closely to the circuit board surface, thereby conserving valuable space.

To meet the foregoing needs, low profile receptacles have been developed. Specifically one such low profile contact means, which is stamped from a continuously fed supply of stock material, is generally cylindrical in shape and open at one end, with portions of the open end thereof being flared outwardly to provide an entrance for the mating male pin. The cylindrical portion comprises opposing tangs or finger-like elements which are secured to the rim of the open end of the female receptacle and are bent back upon themselves to extend inwardly towards each other in the center portion of the cylindrically shaped receptacle to receive and grip a male post inserted therebetween.

One such prior art structure is shown in U.S. Pat. No. 2,858,153 issued Aug. 24, 1973, to Coller et al. Another such prior art device is shown in application Ser. No. 589,092, filed June 23, 1975, by Robert Franklin Cobaugh et al and entitled "Low Profile Contact" and assigned to the assignee of the subject application.

In such prior art structures those finger-like contacts which are folded back upon themselves and extend into the interior portion of the cylindrically-shaped female receptacle generally have a straight, flat configuration. Accordingly, when a misaligned male pin is inserted therein, such male pin frequently will be misaligned and will make contact with one of the folded-over fingers near the point of folding, thereby producing large bending stress forces in such folding areas. Such large forces will deflect the folded-over fingers beyond their limits of elasticity to produce permanent distortion thereof, with resulting deterioration in the mechanical and electrical characteristics between the folded-over fingers and the male pins inserted therebetween.

It is to be understood that while the problem of damage to a female receptacle by a misaligned male pin has been discussed above with respect to a female receptacle mounted in a circuit board and even more particularly to a low profile type female receptacle, the problem of damage is much more general.

STATEMENT OF THE INVENTION

It is a primary object of the invention to provide a female terminal constructed to receive, without incurring damage, mating male terminals having a greater degree of misalignment than can be safely tolerated by prior art female receptacles.

It is a second aim of the invention to provide a low profile female receptacle capable of better acceptance, without incurring damage, of mating misaligned male terminals than has heretofore been known.

It is a third object of the invention to provide a female contact which is inserted in a substrate and which is able to receive misaligned male mating pins to a degree of misalignment heretofore unacceptable by prior art terminals without incurring damage to the female terminal.

A fourth purpose of the invention is a female receptacle having a pair of oppositely positioned contact fingers extending from the open end of the receptacle and downwardly thereinto, and further having a configuration which will accept therebetween male pins having a larger degree of misalignment than heretofore allowable without being deflected beyond their elastic limits.

A fifth object of the invention is the improvement of female terminals generally.

BRIEF STATEMENT OF THE INVENTION

In accordance with a preferred embodiment of the invention there is provided a low profile contact consisting of a single element stamped from a section of a continuously fed supply of flat stock material and having a generally cylindrically-shaped female receptacle portion which is open at one end and which engages the walls of an aperture in a substrate through which the contact is inserted. The open end of the receptacle is flared outwardly to form a flange which seats around the aperture on the top surface of the printed circuit board, and which forms a entry guide for an entering male pin. Portions of the flared open end of the receptacle are formed by a pair of oppositely positioned tangs or fingers which are part of the same blank as the cylindrical wall, and which extend outwardly from said cylindrical wall to form flared portions of the receptacle's open end and then are folded back upon themselves towards and into the interior portion of the cylindrical receptacle.

The folded back portions of the two fingers have a configuration whereby beginning from the point of fold-over they initially extend into the interior of the cylindrical receptacle substantially parallel to the axis of said receptacle and immediately adjacent the interior wall of said female cylindrical receptacle. As the two fingers enter further into the female receptacle they are bowed towards each other so as to approach the centerline of the female receptacle, and in some embodiments go past said centerline.

Thus, when a misaligned male pin is inserted in-between the two bent back fingers and comes first into contact with a given one of the fingers near the folded-over portion, the said given finger will be forced back against the inner wall of the cylinder portion and will be stopped thereby, well within its elastic limits. Thus, the chances of permanently setting or distorting said given finger is minimized. As the misaligned pin enters further into the female receptacle it will slide down the finger and progressively deflect an increasing amount of said finger towards the interior wall of the female receptacle. Since the finger is bowed inwardly towards the axis of the female receptacle cylinder, i.e., away from the receptacle wall, the point of contact between the bowed finger and the inner surface of the wall of the female receptacle will move progressively down the wall of the female receptacle as the male pin forces said finger towards said wall of said receptacle. Thus, the effective beam length of the finger is shortened, thereby removing stress from the section of the finger above the point of contact between the finger and the cylinder wall.

In accordance with a feature of the invention, one of the two opposed, bowed fingers is longer than the other and is caused to be extended across the center axis of the female receptacle underneath the end of the other, shorter finger, which is also bowed inwardly towards the axis of said female receptacle from the opposite side wall of said cylinder. Because one of the fingers extends further into the female receptacle and overlaps the end of the other, shorter finger, a better electrical and mechanical contact between said fingers and the male pin inserted therebetween is obtained.

BRIEF DESCRIPTION OF THE DRAWINGS

The above-mentioned and other objects and features of the invention will be more clearly understood from the following detailed description thereof when read in conjunction with the drawings in which.

DETAILED DESCRIPTION OF THE INVENTION

Figure 1:
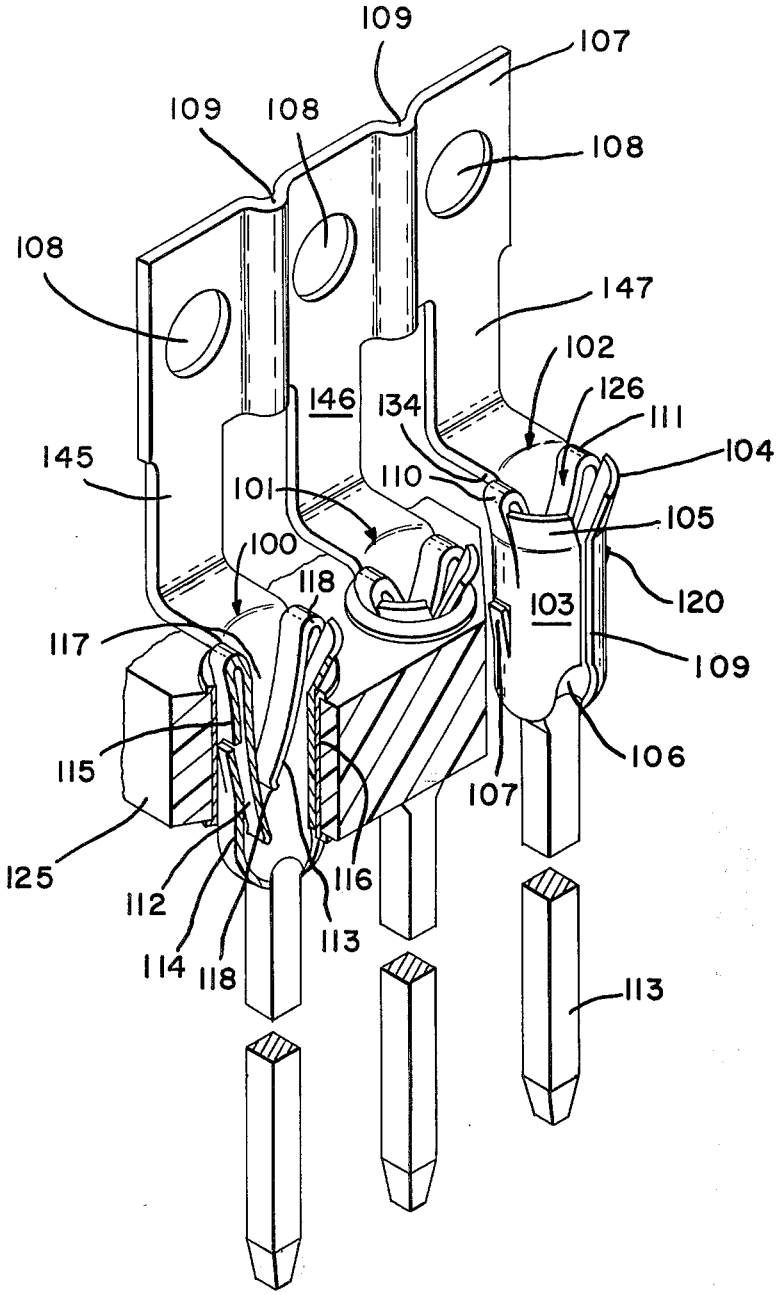
FIG. 1 is a perspective view with portions broken away of three of the contacts of the present invention, two of which are inserted in a printed circuit board with portions thereof broken away.

Referring now to FIG. 1 the three terminals 100, 101 and 102 are all secured to a common carrier strip 107 and terminals 100 and 101 are shown mounted within a circuit board 125, with portions thereof broken away on both the circuit board 125 and one of the contacts 100 to show the relationship between the terminals and the aperture in the circuit board in which they are mounted.

Referring first, however, to the terminal 102 which is shown not mounted within the circuit board, it can be seen that such terminal 102 consists of a cylindrically or tubularly shaped body 103 with flared parts 105 and 104 formed at the upper, open end 126 thereof to provide a guide for entry of a male terminal post (not shown) which fits within the said open end 126. The opposite side of the open end 126 of terminal 102 is secured to the carrier strip 107 via a neck or connecting piece 147. The carrier strip 107 has a series of holes 108 therein which are employed for assembly purposes in that they identify the position of each terminal attached thereto. Further, the carrier strip 107 can have folded portions 109 which permit contraction or expansion of the carrier strip and thereby allow for dimensional tolerances. At the other end of the terminal 102 a post, such as post 113, can be formed and around which another or third wire can be wrapped, or alternatively, the post can fit in another female terminal (not shown in FIG. 1).

A pair of flanges or tang-like fingers 107 and 120 are formed from the body of the tubular portion 103 and are employed to retain the cylindrical tubular portion 103 within the appropriate circuit board aperture, as can be seen more clearly from the cut-away portion of terminal 100, which will be discussed later herein.

Further, the main cylindrical body 103 is formed with a slot 109 therein which is open slightly to permit some decrease in the diameter of the cylindrical body 103 to adapt to circuit board holes of different sizes (tolerances).

The two spring contacts 110 and 111 of terminal 102 are formed by folding extensions of the main body receptacle 103 back upon themselves and into the inner area of the receptacle 103. The foregoing is shown more clearly by reference to the cut away terminal 100 of FIG. 1 wherein the folded-over portions 112 and 113 can be seen to be folded into the inner portion of the cylindrical body 114. Both the bent-over leg contacts 112 and 113 can be seen to be bent-over sharply at the bend-over points 117 and 118, and more specifically are bent-back to be close to the outer walls 115 and 116 of the cylindrical body 114. As they enter further into the interior of receptacle 114 the two beams 112 and 113 are bowed towards each other, with the fingers 112 being slightly longer than the contact 113 and, in fact, passing underneath the end of contact 113, as shown in FIG. 1.

Figure 2:
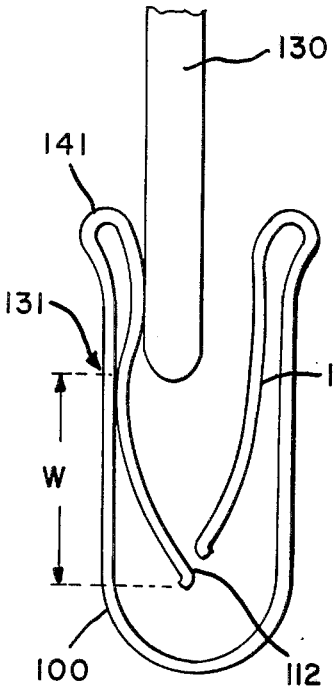
FIGS. 2, 3 and 4 show schematic diagrams of progressive stages of insertion of a male pin into the female receptacle of the invention.
Figure 3:
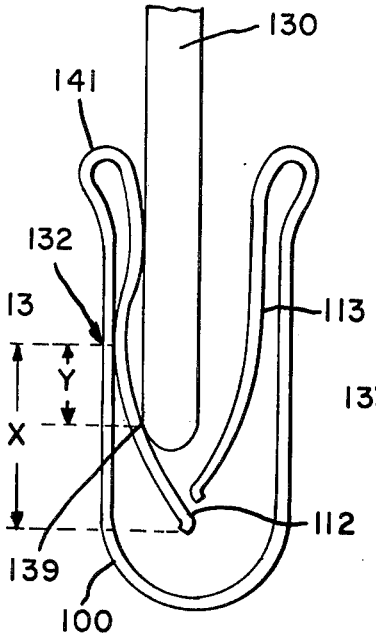
Figure 4:
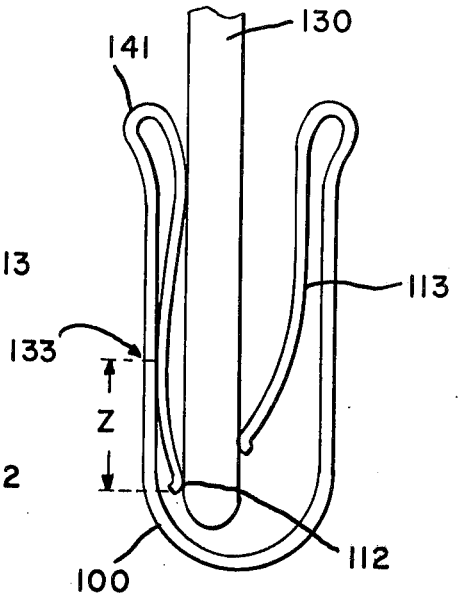

In FIGS. 2, 3 and 4 there is shown the action between the legs 112 and 113 of terminal 100 as a male post terminal 130 is inserted therebetween. More specifically, the post 130 is shown as being inserted slightly off center, i.e., to the left, of the center of the interior of the female receptacle 100. The purpose of showing the post 130 being entered slightly off-center is to illustrate the advantages of the bowed nature of the springs 112 and 113 and how they advantageously can receive the post in an off-centered manner without damage to the spring contacts 112 and 113.

Referring now specifically to FIG. 2 the post 130 is shown just entering the female receptacle 100. The post 130 has deflected the bowed leg 112 slightly to the left so that said leg 112 makes contact with the inner wall of receptacle 100 at point 131. The length of the remainder of the leg 112 then measures a distance W from the point of support 131 on the wall of the receptacle 100 to the free end of leg 112. It should be noted that since the contact 112 does, in fact, come into contact at point 131 with the receptacle 100, the said beam 112 will effectively be prevented from being deflected further to the left of point 131, thereby limiting the deflection of post 112 and insuring that the deflection thereof remains within the elastic limits of post 112. Specifically, the bending stresses around the bent-back portion 141 are limited by virtue of post 112 making contact with the main cylinder body 100 at point 131.

In FIG. 3 the post 130 is shown as having entered still further and still in a misaligned position to the left of center of the aperture of receptacle 100. The bowed beam 112 has now been deflected further to the left and its fulcrum 132 has moved downwardly on the inner wall of receptacle 100. The beam 112 is thus, in effect, a rolling cantilever beam with its fulcrum moveable down the wall of receptacle 100 as the post 130 enters, thereby shortening the effective length of the cantilever beam 112. In FIG. 3, for example, the fulcrum is at point 132 with the projection of the length of beam 112 being equal to length Y, which is noticeably shorter than the projected distance X of FIG. 2, when post 130 was inserted a lesser distance. Since the fulcrum 132 of beam 112 has shifted downward from point 131 the bending strain on the fold-over portion 141 of beam 112 has not changed appreciably. The distance between fulcrum 132 and the point 139 where the post 130 and finger 112 make contact represents the effective length of the finger cantilever beam, and determines the lateral force exerted by finger 112 on post 130.

In FIG. 4 the post 130 is shown in a fully inserted position, causing the beam 112 to be deflected to its leftmost position. The fulcrum 133 of beam 112 has moved even further down into the inner wall of receptacle 100 and the projected length of that portion of contact 112 which forms a cantilever beam is now equal to distance Z, which is approximately equal to the effective beam length Y in FIG. 3. In FIG. 4 it can be seen again that the bending strain on the bent-over portion 141 has decreased somewhat more due to the movement of the fulcrum 133 of the cantilever beam portion of contact 112 downwardly into female receptacle 100. It is also to be noted that post 130 in its fully inserted position of FIG. 4 also makes contact with opposing spring contact 113.

Figure 5:
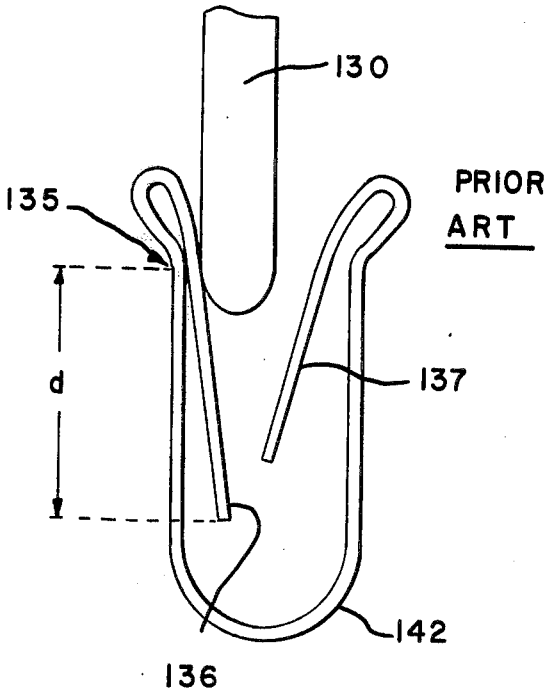
FIG. 5 is a schematic diagram of a male pin entering a prior art type receptacle.

As a contrast to the action of the rolling beam type contacts 112 and 113 of FIGS. 2, 3 and 4, there is shown in FIG. 5 a structure having folded-back contact elements 136 and 137 which are essentially straight. Also shown in FIG. 5 is a post 130 being entered into the receptacle 142 in a misaligned manner, that is to the left of center of receptacle 142. With the structure of FIG. 5, i.e., with the straight beams 136 and 137, a point of bending moment at fulcrum point 135 will immediately occur. As beam 130 is inserted further into receptacle 142 the fulcrum point for beam 136 will remain at point 135 and the force exerted thereon will remain high, very likely causing a deflection of the beam 136 beyond its elastic limits at point 135. Deflection of beam 136 beyond its elastic limits will result in a decreased spring-like force between the inserted post 130 and the beam 136, an undesirable situation. It is to be understood that the structure of FIG. 5 is not a part of the invention, but is described merely for comparison purposes with the invention shown in FIGS. 2, 3 and 4.

In addition to accepting a misalgined post without being damaged thereby, the structure of FIGS. 2 – 4 produces lateral forces between the spring fingers and the post 130 that remain more nearly constant as the post 130 is inserted into the receptacle 100, than is the case with the structure of FIG. 5.

Such more nearly constant lateral force is due to the fulcrum of the cantilever beam spring fingers 112 and 113 following the end of the post 130 as it is inserted in receptacle 100 so that the effective beam length of the spring fingers tend to remain fairly constant.

Figure 10:
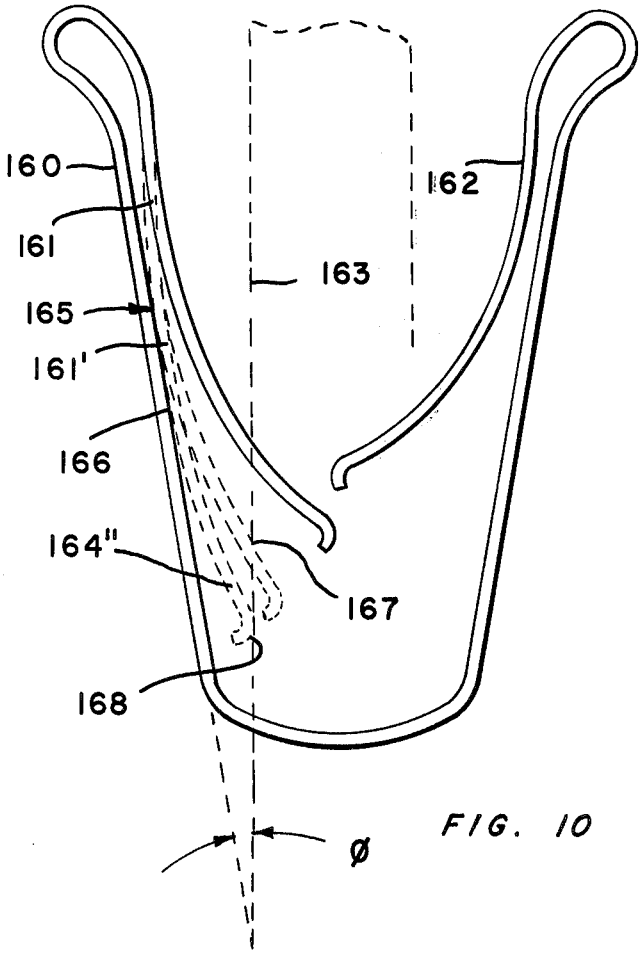
FIG. 10 is a schematic view of another form of the invention.

It is possible, however, to employ other configurations of the receptacle and the spring fingers which will provide different force characteristics between the spring fingers and the post as said post is inserted into the receptacle. For example, in FIG. 10 there is shown a receptacle 160 in which the walls thereof converge towards each other, measured from the open end thereof. The degree of convergence with the centerline or axis of the receptacle is indicated generally by the angle $\phi$ in FIG. 10.

As a post, one edge of which is indicated by dotted line 103, is inserted, the fingers 161 and 162 will be deflected towards the walls of the receptacle 160. Examining only the spring finger 161, the original position of spring 161, without a post being inserted into receptacle 160, is shown in solid lines and designated by reference character 161. As the post is inserted, the spring 161 is deflected to the left and will, at some point of insertion of post 163, assume the dotted position 161'. At position 161' the finger will have been pushed against the side wall of receptacle 160 at point 165 which forms a fulcrum point for the finger 161'. The effective beam length of the springfinger 161' is approximately equal to the distance between the fulcrum point 165 and point 167, where it makes contact with the entering post 163.

When the post 163 is fully entered, the spring finger 161 will assume the position 161'' with its fulcrum at point 166. The beam length of the finger 161'' will then be the distance between points 166 and 168, which is a shorter distance than the distance between points 165 and 167. The lateral force existing between the spring finger 161'' and the post 163 is greater than the lateral force existing between the partially inserted post 163 and the spring finger at position 161'.

Various other configurations of beam and wall configuration are susceptible to mathematical analysis to provide a variety of force characteristics as the post is inserted into the receptacle. By and large such modifications of configurations are matters of design depending upon the force characteristics desired for any particular application.

Figure 6:
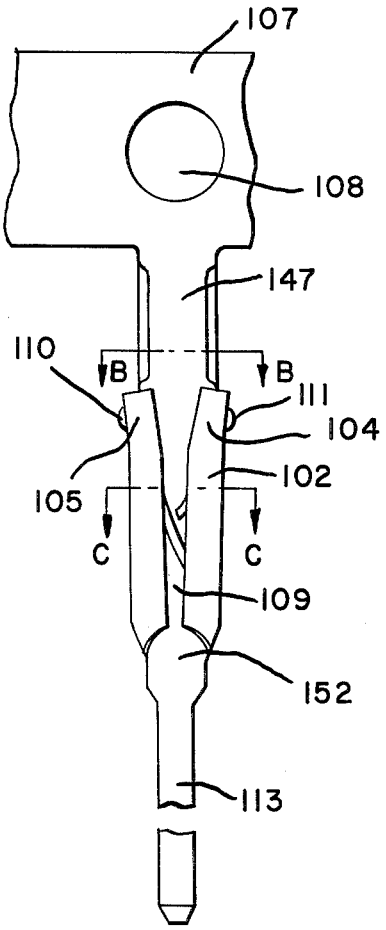
FIG. 6 is a plan view of one of the terminals of the present invention.
Figure 7:
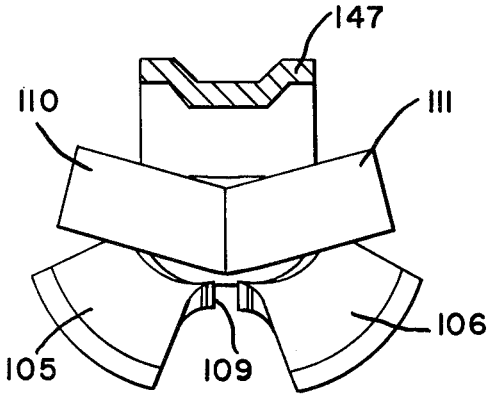
FIG. 7 is a sectional view of the contact of FIG. 6 taken along the plane B—B.
Figure 8:
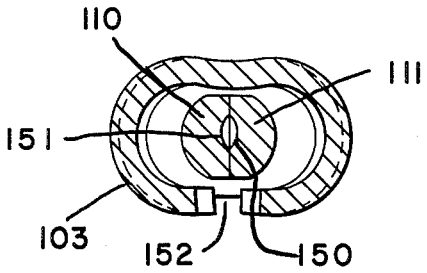
FIG. 8 is a sectional view of the contact of FIG. 6 taken along the plane C—C.
Figure 9:
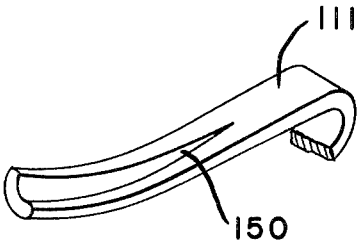
FIG. 9 is a plan view of the blank form of the contact before being formed into their final shape.

In FIG. 6 there is shown a plan view of the terminal 102 of FIG. 1. Similar portions thereof are identified by the same reference characters. Of the view shown in FIG. 6, two sections are taken. One section is taken along the plane B—B and is shown in FIG. 7 and the other section is taken along the plane C—C and shown in FIG. 8. In FIG. 7 the angular relationship of the two flared out portions 105 and 106 with the bent-back and inwardly projecting contact fingers 110 and 111 can more clearly be seen. While the facing surfaces of the two contact fingers 110 and 111 appear to be flat in FIG. 7 they can be seen to have, in one preferred embodiment thereof shown in FIG. 9, a concave groove 150 extending down most of the length thereof which performs the function of guiding the received end of the post being inserted between fingers 110 and 111. The groove 150 in contact finger 111 and the opposing groove 151 in the other contact finger 110 can be seen more clearly in the sectional view of FIG. 8. Also in FIG. 8 it is shown that the receptacle can be oval in cross-sectional configuration, as well as circular.

It is to be understood that the forms of the invention shown and described herein are but preferred embodiments thereof and that various changes may be made in the detailed configuration of the folded-back contact springs and the relative dimensional proportions without departing from the spirit or scope of the invention.

We claim:

1. A female contact comprising:

a tubular portion having an inner surface and open at one end;

at least one contact finger extending outwardly and upwardly from a given portion of the open end of said tubular portion and bent back upon itself to extend into the interior of said tubular portion downwardly and closely adjacent the section of the inner surface of said tubular portion near the said given portion of said open end thereof and then following a curved path, having a generally concave side and a generally convex side, away from said section of said inner surface and towards the other side of said tubular portion with the concave side of said curved finger facing said other side of said tubular portion.

2. A single element low profile female contact for receiving a male terminal and constructed entirely from a section of flat stock material and which is adapted for insertion through an aperture in a substrate and which compriss:

a tubular portion having walls of said stock material, having an inner surface, open at one end and having an open seam extending axially along one side thereof;

a pair of contact fingers each extending outwardly and upwardly from opposite sides of said open end of said tubular portion and bent back upon themselves to extend into the interior of said tubular portion;

each of said contact fingers extending downwardly past the point of its connection to said tubular portion and closely adjacent the said inner surface of the wall of the tubular portion and then following a curved path, having a generally concave side and a generally convex side, away from said inner surface and towards the other of said contact fingers, and with its concave side facing the concave side of said other finger; and the portions of said contact fingers extending outwardly and upwardly from said open end of said tubular portion forming a seat for said tubular portion upon said substrate and further forming a guide for entry of said male terminal.

3. A single element low profile female contact as in claim 2 and further comprising flared means extending upwardly and outwardly from said open end of said tubular portion to provide further seating support for said tubular portion on said substrate and to provide further guidance for insertion of said male terminal.

4. A single element low profile female contact as in claim 2 in which one of said contact fingers is longer than the other contact finger and extends underneath said other contact finger with respect to the open end of said tubular portion.

5. In combination with a substrate, a single element female contact for receiving a male pin, constructed entirely from a section of flat stock material, and inserted through an aperture in said substrate, and comprising:

a tubular portion having walls of said flat stock with an inner surface, and being open at one end; and a pair of contact fingers integrally connected to oppositely positioned portions of said open end of said tubular portion and extending outwardly and upwardly in opposite directions from said open end of said tubular portion and bent back upon themselves to extend into the interior of said tubular portion;

each of said contact fingers extending downwardly and closely adjacent the inner surface of the wall nearest the connection thereof to said each contact finger and near the said open end thereof and then following a curved path, having a generally concave side and a generally convex side, away from said wall and towards the other of said fingers, with the concave side of said each finger facing the concave side of said other finger; and the portions of said fingers extending outwardly and upwardly from said open end of said tubular portion forming a seat for mounting upon said substrate and further forming a guide for entry of said male pin.

6. A combination as in claim 5 in which one of said contact fingers is longer than the other contact finger and extends underneath said other contact finger with respect to the open end of said tubular portion.

7. A combination as in claim 5 and further comprising means extending outwardly in a flared manner from said open end of said tubular portion to provide further support for said tubular portion on said substrate and to provide further guidance for insertion of said male pin.

8. A female contact comprising:

a tubular portion defined by a wall having an inner surface and open at on end;

at least two contact fingers extending outwardly and upwardly from opposite sides of said open end of said tubular portion;

each of said contact fingers being further bent back upon themselves to extend into the interior of said tubular portion in a direction downwardly and immediately adjacent said inner surface near the said open end of said tubular portion and then following a curved path, having a generally concave side and a generally convex side, away from said inner surface and towards the other of said contact fingers, with the concave side of said each contact finger facing the concave side of said other contact finger.

9. A female contact as in claim 8 in which one of said contact fingers is longer than the other contact finger and extends underneath said other contact finger with respect to the open end of said tubular portion.

10. A female contact as in claim 8 and further comprising means extending outwardly in a flared manner from said open end of said tubular portion to provide further seating means for said tubular portion on said substrate and to provide guidance for insertion of said male terminal.

11. In combination with a substrate having an aperture therein, a single element low profile contact inserted through said aperture in said substrate and comprising:

a tubular element open at one end;

a pair of substantially opposed contact fingers extending outwardly and upwardly from opposite sides of said open end of said tubular element and bent back upon themselves to extend into the interior of said tubular element;

each of said contact fingers extending downwardly into said interior of said tubular element near the inner surface of the wall of the tubular element near the said open end thereof and then following a curved path, having a generally concave side and a generally convex side, away from said wall and towards the other of said contact fingers, with its concave side facing the concave surface of said other contact finger; and said tubular element having second portions of its open end flared outwardly and upwardly.

* * * * *